US007886494B1

(12) United States Patent
Schott

(10) Patent No.: US 7,886,494 B1
(45) Date of Patent: Feb. 15, 2011

(54) MULTIPLE BRACKET DECKING APPARATUS

(76) Inventor: Patrick A. Schott, 273 Anderson Ave., Croswell, MI (US) 48422

( * ) Notice: Subject to any disclaimer, the term of this patent is extended or adjusted under 35 U.S.C. 154(b) by 304 days.

(21) Appl. No.: 12/211,708

(22) Filed: Sep. 16, 2008

(51) Int. Cl.
*E04B 2/30* (2006.01)
*E04B 1/61* (2006.01)

(52) U.S. Cl. ..... 52/489.1; 52/715

(58) Field of Classification Search ..... 52/489.1, 52/489.2, 509, 512, 582.1, 650.3, 714, 715; 403/388, 389, 397
See application file for complete search history.

(56) References Cited

U.S. PATENT DOCUMENTS

| | | | | | |
|---|---|---|---|---|---|
| 2,335,303 | A | * | 11/1943 | Olsen | 52/512 |
| 3,237,360 | A | * | 3/1966 | Mills | 52/489.2 |
| 4,260,277 | A | | 4/1981 | Daniels | |
| 4,896,985 | A | * | 1/1990 | Commins | 403/11 |
| 4,925,141 | A | * | 5/1990 | Classen | 248/217.2 |
| 4,965,980 | A | | 10/1990 | Leavens | |
| 5,623,803 | A | | 4/1997 | Willis | |
| 5,887,331 | A | * | 3/1999 | Little | 29/509 |
| 5,997,209 | A | * | 12/1999 | Sachs | 403/388 |
| 6,540,432 | B2 | * | 4/2003 | Albanese | 403/388 |
| D488,373 | S | | 4/2004 | Eberle | |
| 7,104,022 | B2 | | 9/2006 | Burgess | |
| D547,169 | S | | 7/2007 | Harris | |

* cited by examiner

*Primary Examiner*—Robert J Canfield
*Assistant Examiner*—Christine T Cajilig
(74) *Attorney, Agent, or Firm*—Crossley Patent Law; Mark A. Crossley

(57) ABSTRACT

The multiple bracket decking apparatus provides multiple brackets for installing deck boards to adjoining structures. The brackets ideally provide for about ⅛-3/16 inch space between boards. While the apparatus is especially ideal for use with deck boards which are made of composites, the apparatus is also excellent for use with deck boards made of other materials. The brackets are especially suited to deck boards with grooves into which the tangs of the brackets fit. The brackets of the apparatus uniquely provide for the use of nails and nail guns for fastening the brackets. This advantage provides greatly reduced labor costs and well as reduced fastener costs. A further advantage provided by the apparatus is the fourth bracket, which provides for angled deck boards, in relation to supporting joists.

10 Claims, 7 Drawing Sheets

MULTIPLE BRACKET DECKING APPARATUS

BACKGROUND OF THE INVENTION

Various brackets exist for installing board and synthetic decking to adjoining structures such as joists, fascias, supports, and the like. The art typically finds a single bracket designed for a single use, which is insufficient for a deck project. And, most brackets for the above purposes are screwed into adjoining structures, a time consuming process and one which is almost always accessed with difficulty, hence the use of screws instead of nails driven by hammers or nail guns. Time spent in labor is costly. Additionally, many such brackets are visible after a project is completed. Visible brackets are undesirable for more than one reason, the reasons including the fact that visible brackets should be made from tarnish, rust-free materials, which are expensive. A further reason is that visible brackets are typically unsightly. The present apparatus solves these problems and more.

FIELD OF THE INVENTION

The multiple bracket decking apparatus relates to deck installation brackets and more especially to an apparatus with multiple, different brackets which provide for installation and spacing of decking materials to adjoining structures.

SUMMARY OF THE INVENTION

The general purpose of the multiple bracket decking apparatus, described subsequently in greater detail, is to provide a multiple bracket decking apparatus which has many novel features that result in an improved multiple bracket decking apparatus which is not anticipated, rendered obvious, suggested, or even implied by prior art, either alone or in combination thereof.

To attain this, the multiple bracket decking apparatus provides multiple brackets for installing decking to adjoining structures. Decking is typically made from composites and from natural or treated woods. For explanation's sake, decking will be referred to herein as deck boards. Proper support and installation of deck boards is provided by the apparatus, as is proper spacing, both to meet guidelines and to ensure installation of deck boards in the most advantageous manner. Spacing of composite deck boards between themselves and other structures ideally comprises ⅛-3⁄16 inch, although various embodiments of the apparatus are provided which offer different spacing for deck boards made of different materials.

While the apparatus is especially ideal for use with deck boards which are made of composites, the apparatus is also excellent for use with deck boards made of other materials. The brackets are especially suited to deck boards with grooves into which the tangs of the brackets fit. The brackets of the apparatus provide for the use of nails for fastening the brackets, rather than screw requirements of other devices in the art, because sufficient space is available for hammer and for nail gun access, a unique feature. This advantage provides greatly reduced labor costs and well as reduced fastener costs. A further advantage provided by the apparatus is the fourth bracket, which provides for angled deck boards, in relation to supporting joists. The ideal angle provided by the fourth bracket is 45 degrees, but other embodiments of varying degrees are provided. While the illustrated apparatus may offer ideal design features and production advantages, more basic designs of the brackets are employed as needed.

Thus has been broadly outlined the more important features of the improved multiple bracket decking apparatus so that the detailed description thereof that follows may be better understood and in order that the present contribution to the art may be better appreciated.

An object of the multiple bracket decking apparatus is to provide for labor cost savings by reducing labor time in decking installation.

Another object of the multiple bracket decking apparatus is to negate the need for expensive material use in bracket manufacture.

A further object of the multiple bracket decking apparatus is to space a deck board a specific distance apart from an adjoining deck board.

An added object of the multiple bracket decking apparatus is to provide for the use of nails and nail guns rather than screws in installing the brackets.

And, an object of the multiple bracket decking apparatus is to provide for hiding all or substantially all of the brackets used, in a completed deck project.

Yet another object of the multiple bracket decking apparatus is to accommodate perpendicularly disposed deck boards and joists as well as deck boards and joists disposed at an angle.

These together with additional objects, features and advantages of the improved multiple bracket decking apparatus will be readily apparent to those of ordinary skill in the art upon reading the following detailed description of presently preferred, but nonetheless illustrative, embodiments of the improved multiple bracket decking apparatus when taken in conjunction with the accompanying drawings.

In this respect, before explaining the current embodiments of the improved multiple bracket decking apparatus in detail, it is to be understood that the multiple bracket decking apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved multiple bracket decking apparatus. It is therefore important that the claims be regarded as including such equivalent constructions insofar as they do not depart from the spirit and scope of the multiple bracket decking apparatus.

It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 7 thereof, the principles and concepts of the multiple bracket decking apparatus generally designated by the reference number will be described.

Figure 6:
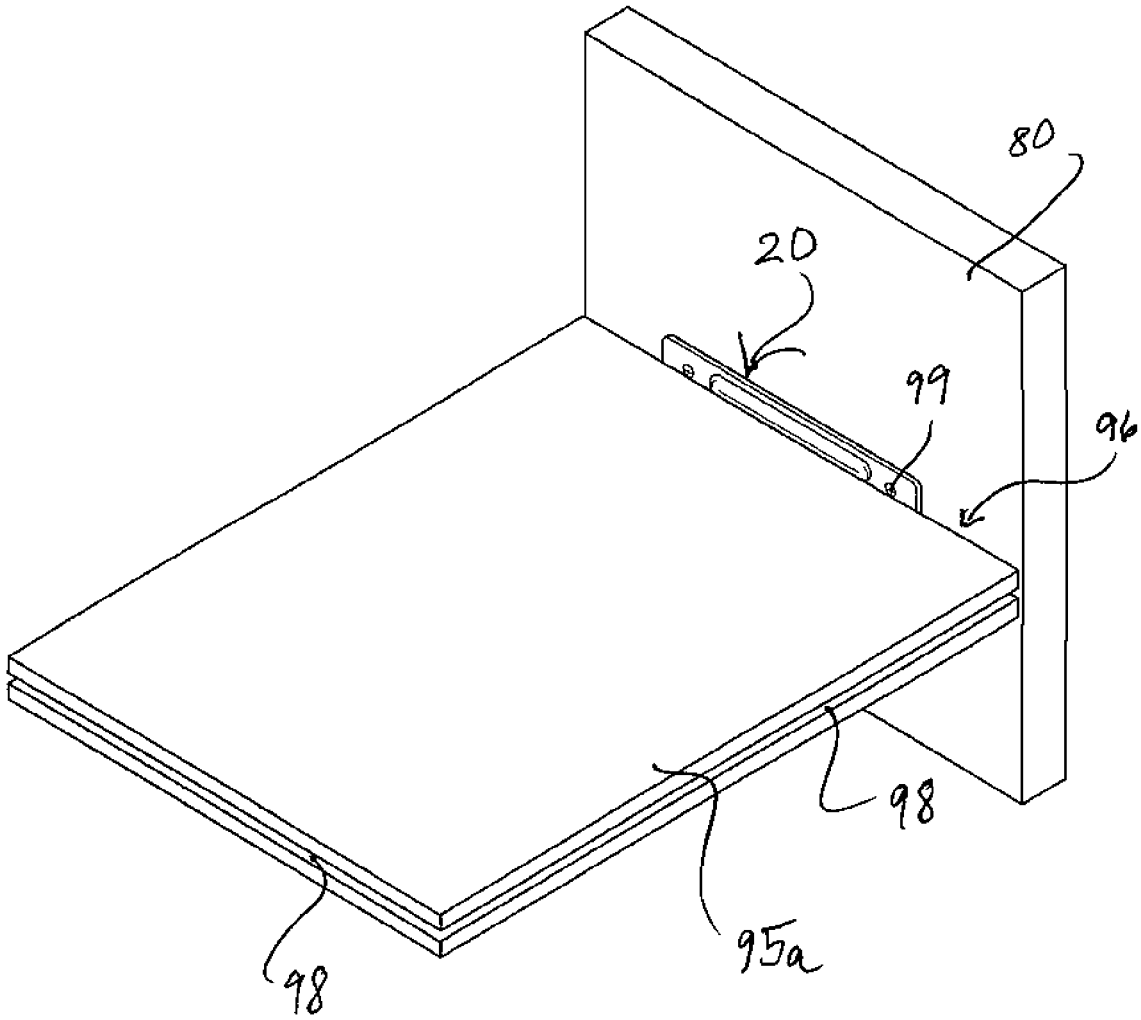
FIG. 6 is a perspective view of the first bracket in use.
Figure 7:
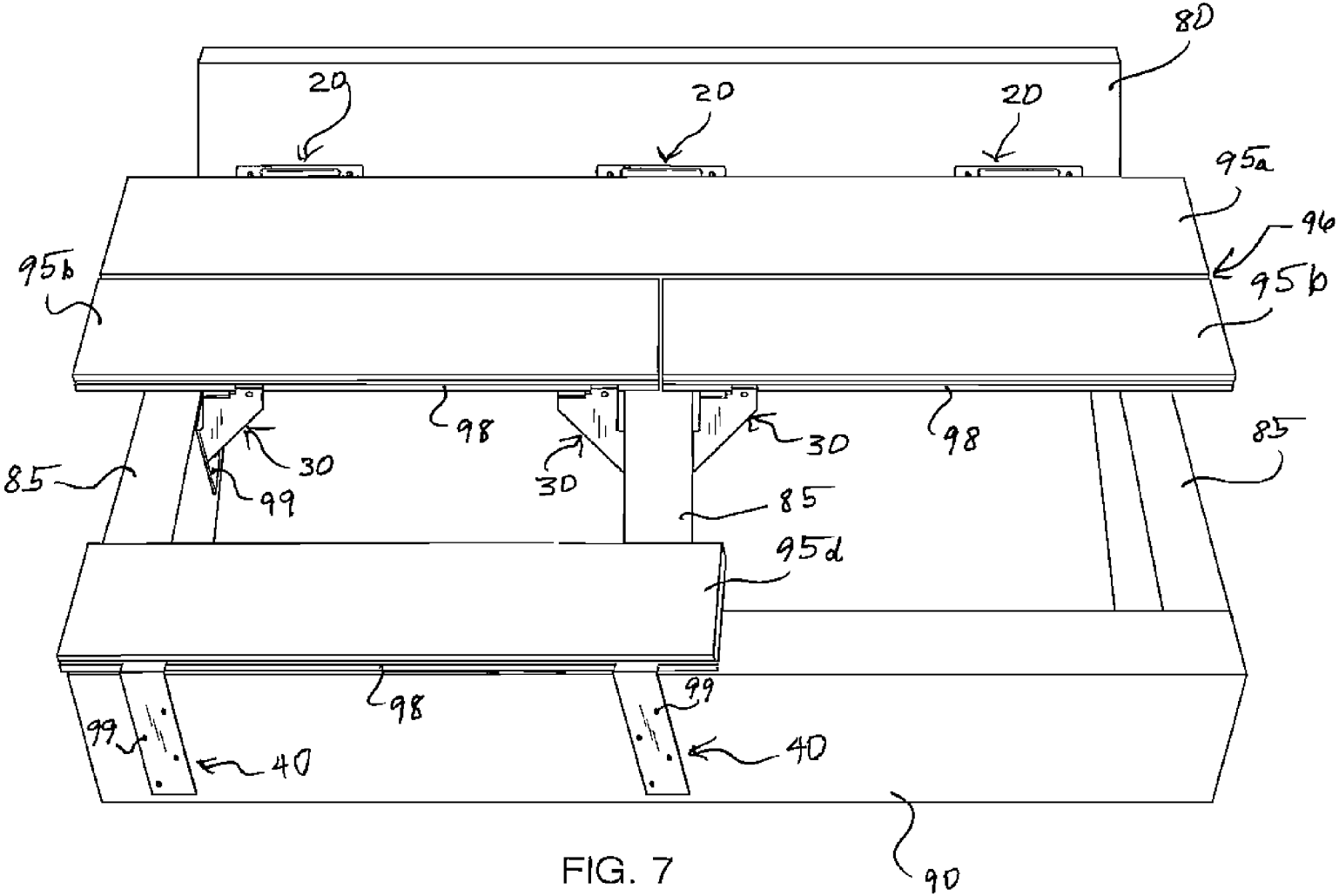
FIG. 7 is a perspective view of the first, second, and third brackets in use.

Referring to FIGS. 6 and 7, the first bracket 20 of the apparatus 10 is selectively attached to an existing structure 80. The structure 80 is typically the starting point of a deck. The initial deck board 95*a* is abutted against the first bracket 20.

Figure 5:
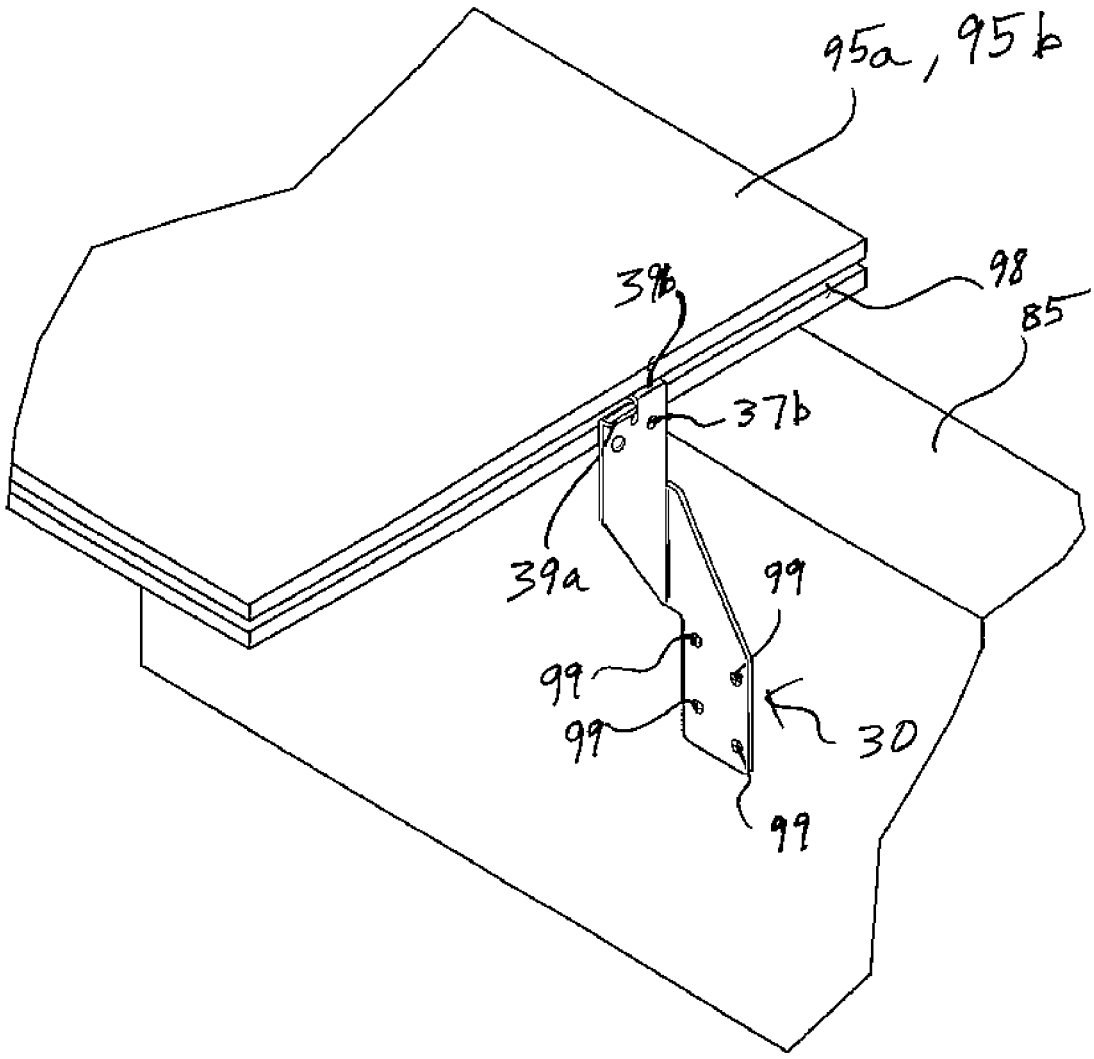
FIG. 5 is a perspective view of the second bracket in use.

Referring to FIGS. 5 and 7, the second bracket 30 is abutted to the initial deck board 95*a*. The second tang 39*b* is fitted within the groove 98. The second bracket 30 is affixed to the existing joist 85 via nails 99. Other types of deck boards without grooves 98 are also used with the apparatus 10. The tangs of the second bracket 30 are provided in varied lengths such that boards installed without grooves are also correctly spaced apart. The brackets of the apparatus 10 provide for a space 96 of between ⅛ inch and 3/16 inch between deck boards. The second brackets 30 are affixed to both sides of the existing joist 85 when two separate adjoining deck boards 95*b* are used. The second brackets 30 are concealed by subsequent addition of further adjoining deck boards 95*b*.

Figure 4:
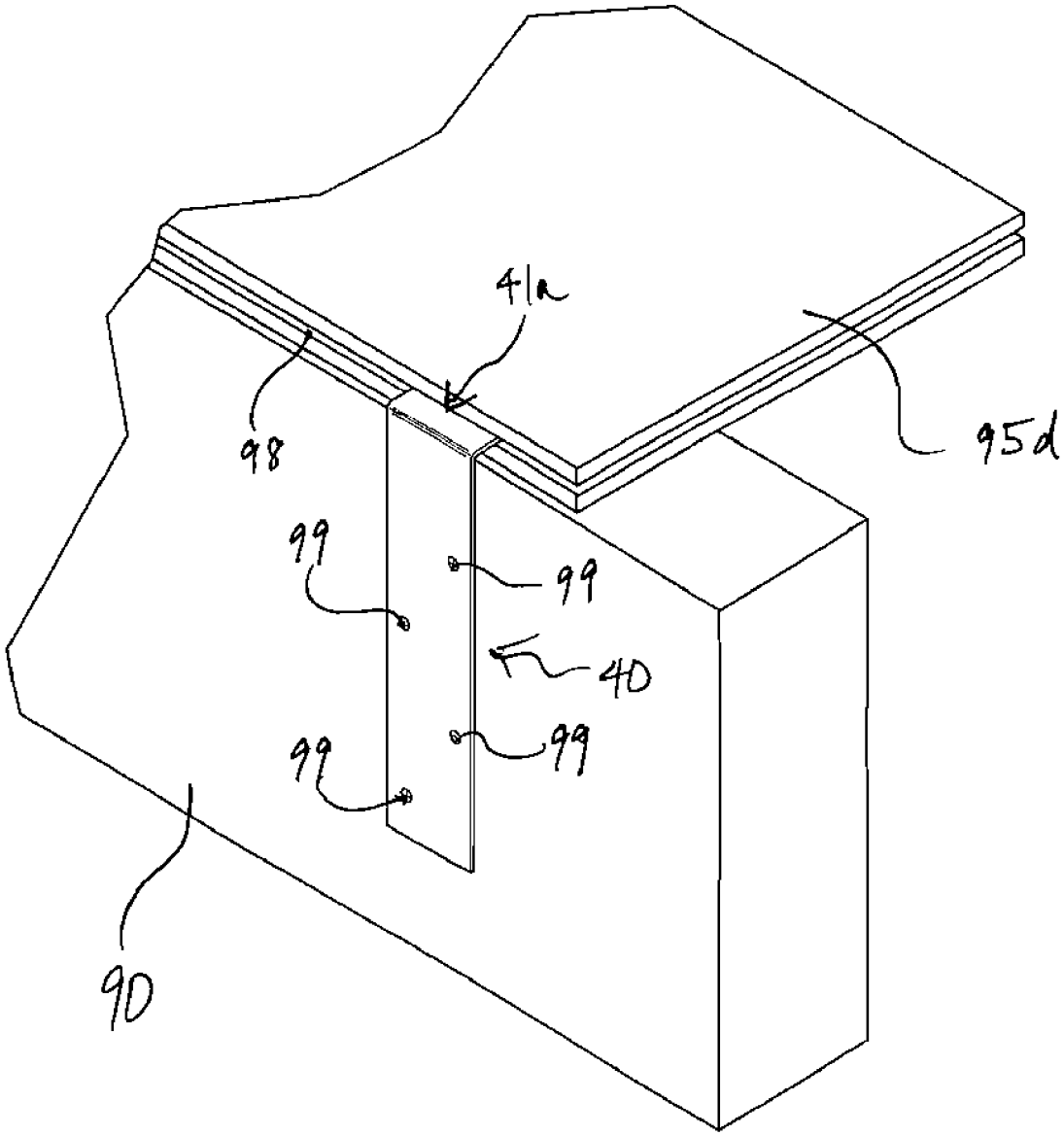
FIG. 4 is a perspective view of the third bracket in use.

Referring to FIGS. 4 and 7, the third bracket 40 is affixed to the existing support 90. The third bracket tang 44 is fitted within the groove 98 of the final deck board 95*d*. The third bracket 40 is affixed with nails 99. Although not shown, a fascia is typically applied to the outer surface of the third bracket 40 and the existing support 90, thereby concealing the third bracket 40.

Figure 1:
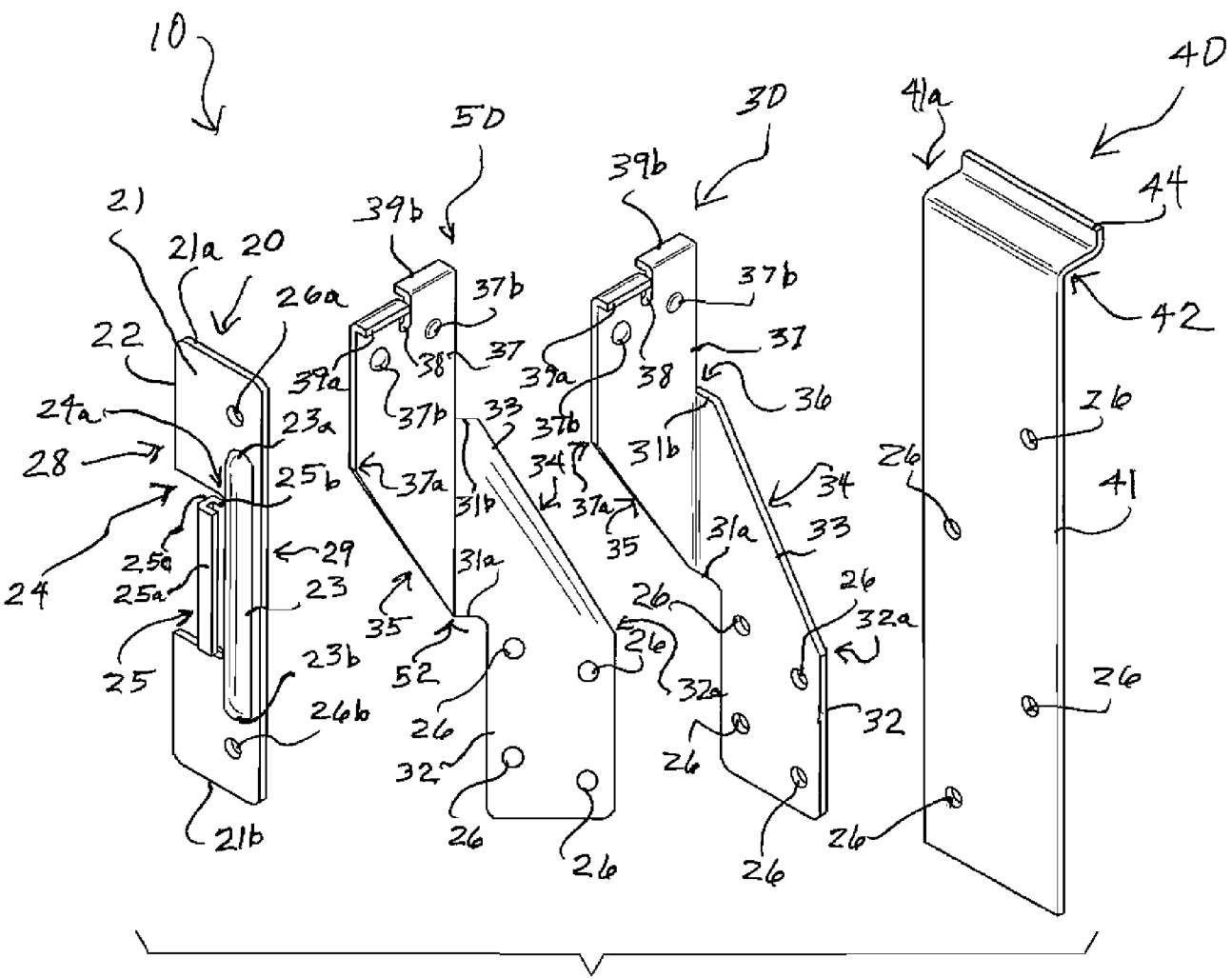
FIG. 1 is a perspective view.
Figure 2:
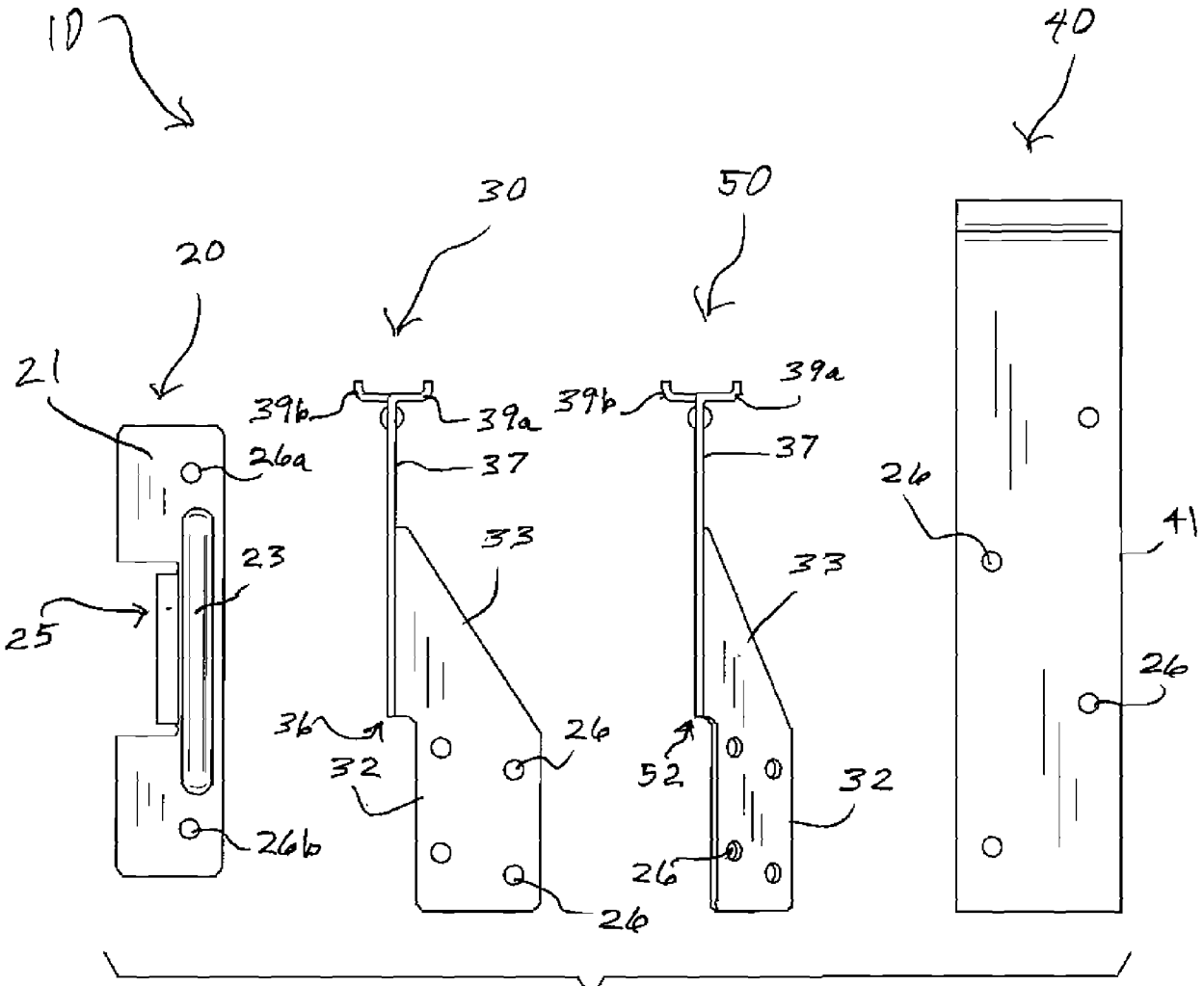
FIG. 2 is a front elevation view.
Figure 3:
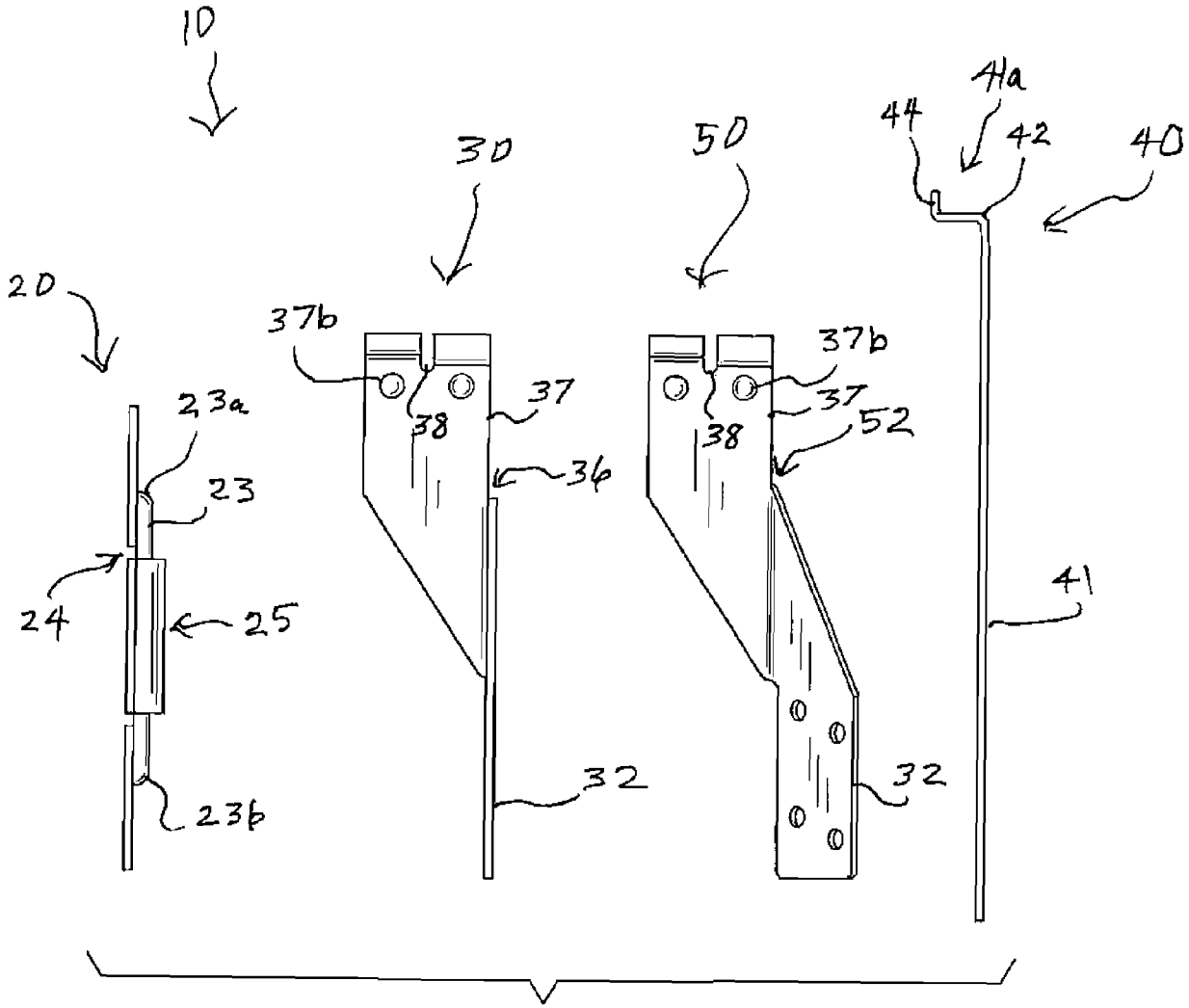
FIG. 3 is a lateral elevation view.

Referring to FIGS. 1, 2, and 3, the multiple bracket decking apparatus 10 is comprised of four separate brackets comprised of the first bracket 20, the second bracket 30, the third bracket 40, and the fourth bracket 50. The first bracket 20 is selectively attached to an existing structure 80. The first bracket 20 is disposed between the existing structure 80 and an existing initial deck board 95*a*. The first bracket 20 has a first bracket side 28 spaced apart from a second bracket side 29, a first bracket end 21*a* spaced apart from a second bracket end 21*b*, and a front surface 21.

The first bracket 20 further comprises a cutout 24 within the first bracket side 28. The cutout 24 comprises a cutout base 24*a* within the cutout 24. The u-shaped fold 25 is extended from the cutout base 24*a*. The u-shaped fold 25 has a projected tang 25*a* extended outwardly from the front surface 21. The base 25*c* is extended perpendicularly from the projected tang 25*a*. The second side 25*b* is extended perpendicularly from the base 25*c*. The second side 25*b* is extended from the cutout base 24*a*. The first bracket 20 also comprises the raised channel 23 raised from the front surface 21. The raised channel 23 has a first channel end 23*a* spaced apart from a second channel end 23*b*. The pair of orifices 26 within the first bracket 20 comprise the first orifice 26*a* spaced apart from the second orifice 26*b*. The first orifice 26*a* is proximal to the first bracket end 21*a*. The second orifice 26*b* is proximal to the second bracket end 21*b*. The first bracket 20 positions the initial deck board 95*a* and existing structure 80 with a specific space 96 therebetween.

The second bracket 30 is selectively attached to an existing joist 85 which is perpendicularly disposed to the existing structure 80. The second bracket 30 is attached between the initial deck board 95*a* and an adjoining deck board 95*b*. The second bracket 30 comprises a bottom rectangle 32. The bottom rectangle 32 has a bottom rectangle top 32*a*. A plurality of spaced apart orifices 26 is disposed within the bottom rectangle 32. The upper rectangle 37 is spaced apart from the bottom rectangle 32. The upper rectangle 37 further comprises a pair of spaced apart dimples 37*b*. The upper rectangle 37 also comprises the first tang 39*a* spaced apart from the second tang 39*b*. Each tang is perpendicular to the upper rectangle 37. The notch 38 is disposed between the first tang 39*a* and the second tang 39*b*. The midsection 33 is disposed between the bottom rectangle top 32*a* and the upper rectangle bottom 37*a*. The midsection 33 comprises the first slant 34 spaced apart from the second slant 35. The first slant 34 is extended from the bottom rectangle top 32*a* to the upper extension 31*b*. The upper extension 31*b* is connected to the upper rectangle bottom 37*a*. The second slant 35 is connected to the lower extension 31*a* and to the bottom rectangle top 32*a*. The 90 degree bend 36 is extended from the connected upper extension 31*b* and upper rectangle bottom 37*a* to the lower extension 31*a*. The third bracket 40 is selectively attached externally to an existing support 90. The third bracket is in abutment to a final deck board 95*d*. The third bracket 40 comprises the rectangular section 41. The rectangular section 41 has a section top 41*a*. The third bracket 40 further comprises the plurality of spaced apart orifices 26 disposed within the rectangular section 41. The right angle bend 42 is connected to the section top 41*a*. The third bracket tang 44 is extended perpendicularly upward from the right angle bend 42.

The fourth bracket 50 is selectively affixed to an existing joist 85 for disposing an initial deck board 95*a* and adjoining deck boards 95*b* at a 45 degree angle to a joist 85. The fourth bracket 50 is therefore optionally included in the apparatus 10. The fourth bracket 50 is disposed between the existing initial deck board 95*a* and the adjoining deck board 95*b*. Additional fourth brackets 50 are selectively affixed between further adjoining deck boards 95*b* as a deck size increases. The fourth bracket 50 partially comprises the bottom rectangle 32. The bottom rectangle 32 has a bottom rectangle top 32*a*. Fourth brackets 50 position initial deck boards 95*a* and adjoining deck boards 95*b* with a specific space 96 therebetween.

A plurality of spaced apart orifices 26 is disposed within the bottom rectangle 32. The upper rectangle 37 is spaced apart from the bottom rectangle 32. The upper rectangle 37 further comprises the pair of spaced apart dimples 37*b*. The first tang 39*a* is spaced apart from the second tang 39*b*. Each tang is perpendicular to the upper rectangle 37. The first tang 39*a* faces opposite the second tang 39*b*. The notch 38 is disposed between the first tang 39*a* and the second tang 39*b*. The midsection 33 is disposed between the bottom rectangle top 32*a* and the upper rectangle bottom 37*a*. The midsection 33 comprises the first slant 34 spaced apart from the second slant 35. The first slant 34 is extended from the bottom rectangle top 32*a* to the upper extension 31*b*. The upper extension 31*b* connects to the upper rectangle bottom 37*a*. The second slant 35 is connected to the lower extension 31*a* which is connected to the bottom rectangle top 32*a*. The second slant is further connected to the upper rectangle bottom 37*a*. The midsection of the fourth bracket 50 is identical to the midsection 33 of the second bracket 30. The bottom rectangle 32 and the upper rectangle 37 of the second bracket 30 and the fourth bracket 50 are identical. The 135 degree bend 52 is extended from the connected upper extension 31*b* and upper rectangle bottom 37*a* to the lower extension 31*a*. The fourth bracket 50 differs from the second bracket 30 in that the 135 bend 52 of the fourth bracket exceeds the 90 degree bend 36 of the second bracket 30.

With respect to the above description then, it is to be realized that the optimum dimensional relationships for the parts of the multiple bracket decking apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the multiple bracket decking apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the multiple bracket decking apparatus may be used.

Therefore, the foregoing is considered as illustrative only of the principles of the multiple bracket decking apparatus. Further, since numerous modifications and changes will readily occur to those skilled in the art, it is not desired to limit the multiple bracket decking apparatus to the exact construction and operation shown and described, and accordingly, all suitable modifications and equivalents may be resorted to, falling within the scope of the multiple bracket decking apparatus.

What is claimed is:

1. A multiple bracket decking apparatus, comprising, in combination:

a first bracket selectively attached to an existing structure, the first bracket disposed between the existing structure and an existing initial deck board, the first bracket having a first bracket side spaced apart from a second bracket side, a first bracket end spaced apart from a second bracket end, a front surface, the first bracket further comprising:

a cutout within the first bracket side;

a cutout base within the cutout a u-shaped fold extended from the cutout base, the u-shaped fold having a projected tang extended outwardly from the front surface, a base extended perpendicularly from the projected tang, a second side extended perpendicularly from the base, the second side extended from the cutout base, the projected tang positioning the initial deck board and existing structure with a space therebetween;

a raised channel within the front surface, the raised channel having a first channel end spaced apart from a second channel end;

a pair of orifices comprising a first orifice spaced apart from a second orifice, the first orifice proximal to the first bracket end, the second orifice proximal to the second bracket end;

a second bracket selectively attached to an existing joist perpendicularly disposed to the existing structure, the second bracket attached between the initial deck board and an existing adjoining deck board, the second bracket comprising:

a bottom rectangle, the bottom rectangle having a bottom rectangle top;

a plurality of spaced apart orifices within the bottom rectangle;

an upper rectangle spaced apart from the bottom rectangle, the upper rectangle further comprising:

a pair of spaced apart tangs perpendicularly affixed atop the upper rectangle, the tangs comprising a first tang and a second tang, the tangs extended from the upper rectangle in opposite directions, the first tang abutting an adjoining deck board, the second tang abutting the initial deck board, the tangs forming a space between the deck boards;

a notch between the first tang and the second tang;

a midsection disposed between the bottom rectangle top and the upper rectangle bottom, the midsection comprising:

a first slant spaced apart from a second slant, the first slant extended from the bottom rectangle top to an upper extension, the upper extension connected to the upper rectangle bottom, the second slant connected to a lower extension connected to the bottom rectangle top;

a 90 degree bend extended from the upper extension to the lower extension;

a third bracket selectively attached externally to an existing support and in abutment to a final deck board, the third bracket comprising a rectangular section having a section top, the third bracket further comprising:

a plurality of spaced apart orifices disposed within the rectangular section;

a right angle bend disposed at the section top;

a third bracket tang extended perpendicularly upward from the right angle bend.

2. The apparatus according to claim 1 wherein the spaces between the deck boards comprises about ⅛-3/16 inch.

3. The apparatus according to claim 1 wherein the orifices in each bottom rectangle further provide for use of a nail gun.

4. The apparatus according to claim 2 wherein the orifices in each bottom rectangle further provide for use of a nail gun.

5. The apparatus according to claim 1 wherein each upper rectangle further comprises a pair of spaced apart dimples disposed below the tangs.

6. The apparatus according to claim 2 wherein each upper rectangle further comprises a pair of spaced apart dimples disposed below the tangs.

7. The apparatus according to claim 3 wherein each upper rectangle further comprises a pair of spaced apart dimples disposed below the tangs.

8. The apparatus according to claim 4 wherein each upper rectangle further comprises a pair of spaced apart dimples disposed below the tangs.

9. A multiple bracket decking apparatus, comprising, in combination:

a first bracket selectively attached to an existing structure, the first bracket disposed between the existing structure and an existing initial deck board, the first bracket having a first bracket side spaced apart from a second bracket side, a first bracket end spaced apart from a second bracket end, a front surface, the first bracket further comprising:

a cutout within the first bracket side;

a cutout base within the cutout a u-shaped fold extended from the cutout base, the u-shaped fold having a projected tang extended outwardly from the front surface, a base extended perpendicularly from the projected tang, a second side extended perpendicularly from the base, the second side extended from the cutout base;

a raised channel within the front surface, the raised channel having a first channel end spaced apart from a second channel end;

a pair of orifices comprising a first orifice spaced apart from a second orifice, the first orifice proximal to the first bracket end, the second orifice proximal to the second bracket end;

a second bracket selectively attached to an existing joist perpendicularly disposed to the existing structure, the second bracket attached between the initial deck board and an existing adjoining deck board, the second bracket comprising:

a bottom rectangle, the bottom rectangle having a bottom rectangle top;

a plurality of spaced apart orifices within the bottom rectangle;

an upper rectangle spaced apart from the bottom rectangle, the upper having an upper rectangle bottom, the upper rectangle further comprising:

a pair of spaced apart dimples;

a pair of spaced apart tangs perpendicularly connected atop the upper rectangle, the tangs comprising a first tang and a second tang, the tangs extended from the upper rectangle in opposite directions, the first tang abutting an adjoining deck board, the second tang abutting the initial deck board, the tangs forming a space between the deck boards;

a notch between the first tang and the second tang;

a midsection disposed between the bottom rectangle top and the upper rectangle bottom, the midsection comprising:

a first slant spaced apart from a second slant, the first slant extended from the bottom rectangle top to an upper extension, the upper extension connected to the upper rectangle bottom, the second slant connected to a lower extension and the upper rectangle bottom, the lower extension connected to the bottom rectangle top;

a 90 degree bend extended from upper extension to the lower extension;

a third bracket selectively attached externally to an existing support and in abutment to a final deck board, the third bracket comprising a bottom rectangle having a section top, the third bracket further comprising:

a plurality of spaced apart orifices disposed within the rectangular section;

a right angle bend connected to the section top;

a third bracket tang extended perpendicularly upward from the right angle bend;

a fourth bracket selectively attached to an existing angled joist disposed at a 45 degree angle to deck boards, the fourth bracket disposed between the initial deck board and the adjoining deck board, the fourth bracket comprising:

a bottom rectangle, the bottom rectangle having a bottom rectangle top;

a plurality of spaced apart orifices within the bottom rectangle;

an upper rectangle spaced apart from the bottom rectangle, the upper rectangle having an upper rectangle bottom, the upper rectangle further comprising:

a pair of spaced apart tangs perpendicularly connected atop the upper rectangle, the tangs comprising a first tang and a second tang, the tangs extended from the upper rectangle in opposite directions, the first tang abutting an adjoining deck board, the second tang abutting the initial deck board, the tangs forming a space between the deck boards;

a notch between the first tang and the second tang;

a pair of spaced apart dimples disposed below the tangs;

a midsection disposed between the bottom rectangle top and the upper rectangle bottom, the midsection comprising:

a first slant spaced apart from a second slant, the first slant extended from the bottom rectangle top to an upper extension, the upper extension connected to the upper rectangle bottom, the second slant connected to a lower extension and to the upper rectangle bottom, the lower extension connected to the bottom rectangle top;

a 135 degree bend extended from the connected upper extension to the lower extension.

10. The apparatus according to claim 9 wherein the spaces formed between the deck boards further comprises about ⅛-3⁄16 inch.

* * * * *